US005130636A

United States Patent [19]

Kumar et al.

[11] Patent Number: 5,130,636

[45] Date of Patent: Jul. 14, 1992

[54] PROTECTIVE CIRCUIT FOR PROVIDING A REFERENCE VOLTAGE AT A BACKPLANE

[75] Inventors: Ashok Kumar, Fremont; David S. Burwell, San Jose, both of Calif.

[73] Assignee: Raynet Corp., Menlo Park, Calif.

[21] Appl. No.: 654,174

[22] Filed: Feb. 12, 1991

[51] Int. Cl.[5] ..... G05F 1/573

[52] U.S. Cl. ..... 323/278; 307/296.6; 361/98

[58] Field of Search ..... 361/18, 98; 323/278, 323/303; 307/296.6

[56] References Cited

U.S. PATENT DOCUMENTS

| | | | |
|---|---|---|---|
| 2,978,630 | 4/1961 | De La Tour . | |
| 3,426,265 | 2/1969 | Till . | |
| 3,509,450 | 4/1970 | McNulty . | |
| 3,571,608 | 3/1971 | Hurd | 307/93 |
| 3,629,692 | 12/1971 | Goyer | 307/296.6 |
| 3,996,498 | 12/1976 | Scharde . | |
| 4,074,334 | 2/1978 | D'Arrigo | 361/79 |
| 4,660,121 | 4/1987 | Kapfer et al. | 361/58 |
| 4,661,879 | 4/1987 | Sato et al. | 361/58 |
| 4,675,551 | 6/1987 | Stevenson et al. | 307/443 |
| 5,006,734 | 4/1991 | Engelbrecht | 307/567 |

*Primary Examiner*—William H. Beha, Jr.
*Attorney, Agent, or Firm*—Dennis E. Kovach

[57] ABSTRACT

A self-correcting protective circuit for providing a reference voltage to a backplane bus wherein the circuit includes a primary transistor, current sensing resistor and diode connected between a supply voltage and the backplane. The combination of a current-limiting resistor and a control transistor is used to sense current flow to the board through the primary transistor and limit same when the backplane bus voltage fluctuates.

8 Claims, 2 Drawing Sheets

PROTECTIVE CIRCUIT FOR PROVIDING A REFERENCE VOLTAGE AT A BACKPLANE

BACKGROUND OF THE INVENTION

This invention relates to a self-correcting protective circuit for establishing a reference voltage for the conductive backplane used to interconnect circuit boards, preferably for use in an office interface unit in a telephone central office or remote extension thereof.

In electronic system it has become common practice to utilize multilayer printed circuit boards separated by dielectric layers, for example vinyl sheet materials, from planar conductive layers. One such conductive layer is referred to as the backplane and contains a plurality of busses which are normally maintained in a known state and serve to distribute or supply signals applied thereto to other printed circuit boards through interconnections. In the field of telecommunications, the backplane busses are interconnected to a number of signal generators and signal receivers via physical connectors such as pin connectors. The backplane is maintained at a normal operating voltage which changes upon receipt of a signal from an outside source. The interconnections with other boards can introduce discontinuities into the circuit paths and create a need for impedance matching circuits at the backplane. The impedance matching circuits operate at voltage levels that typically are substantially different from the voltage level of the system power supply. In the telecommunications field, it is customary to utilize a power supply operating at 48 volts with a 5 volt reference voltage established on the backplane busses and used for the associated impedance matching circuits.

This lower voltage can be derived form the 48 V power supply by utilizing one or more DC-to-DC converters. Since the designed-for power requirements of the circuitry coupled to the backplane remain essentially constant, the direct lowering of the backplane voltage results in a corresponding increase in the current required for the backplane. To avoid having to supply a large current from a single source to the backplane, it has been proposed to utilize a higher reference voltage at the backplane and to provide a separate DC-DC converter on each circuit board, as illustrated in FIG. 3. The individual voltage converters then are coupled to the backplane and establish the reference voltage therefor. The plurality of individual converters are electrically connected in parallel to the backplane.

The use of a parallel configuration of circuits providing a common reference voltage at the backplane on a backplane bus suffers from the problem that a slight mismatch of any of the operating characteristics in the individual circuits results in unequal loads being shared by the circuits. For example, one of the circuit boards may have a higher voltage level than other boards in the parallel configuration. As a consequence, this circuit board will drive the backplane and other associated circuit boards thereby resulting in an unequal sharing of the power. Protection circuitry would have to be provided on each circuit board in order to prevent the unequal sharing of power from damaging the board during operation. This is a costly solution to the problem.

Alternatively, the output terminal of each voltage converter can be coupled to a backplane bus through the serial combination of a diode and a current-limiting resistor, as illustrated in FIG. 4. Each diode serves to prevent current flow back to the converter at each board while the resistor functions to reduce the load imposed on any one circuit board should it carry the higher voltage level. Typically, the resistor is only 1 ohm. Accordingly the protection it provides is only in the case of mismatches between the operating characteristics of the converters. In the event of a short circuit occurring, the current demand on each of the converters will exceed the ability of the resistor to provide any significant current limiting function. As a result, the converters are then protectively shut down, or fail, thereby resulting in the telecommunications equipment ceasing to operate.

Accordingly, the present invention is directed to a circuit for establishing a reference voltage for a backplane and other circuits while providing protection against a short circuit load condition. The circuit utilizes transistors that are maintained in the conductive state so as to be responsive to changing conditions. Also, the circuit corrects to normal operating conditions rapidly. In addition, the circuit is configured to approximate the ideal reference voltage source in that the internal impedance is maintained low in the forward direction.

The present invention has a primary objective the provision of a reference voltage source which can be used individually or in parallel to establish a reference voltage at a backplane in telecommunications equipment.

SUMMARY OF THE INVENTION WITH OBJECTS

The present invention is directed to a circuit which establishes a reference voltage level at its output terminal. The output terminal can be coupled to a backplane bus of a master support circuit board which has conductive runs to other circuit boards. The other circuit boards are physically and electrically interconnected to the master board. The circuit of the present invention provides the known state for the backplane when it is not driven by a signal from another board. In the telecommunications field, the voltage level maintained on the backplane bus is 5 V with 48 V signals being supplied from other signal sources.

In order to maintain the backplane at a stable reference voltage, the circuit providing the voltage must be responsive to changing conditions at the backplane. These conditions require the ability to respond to the presence of a signal at the backplane or the occurrence of a short circuit in the interconnections between circuit and board. Also, the circuit must operate in the presence of higher voltages on the backplane from other reference voltage circuits coupled thereto.

Since the conditions at the backplane are likely to undergo a rapid change, the circuit providing the reference voltage must respond promptly to these changes. To that end, the present circuit utilizes two transistors, a primary and a control transistor, generally connected in parallel which are maintained conductive. The control transistor is prevented from operating in the saturation mode. The transistors are interconnected so that the circuit is self-correcting in that the termination of the perturbation at the backplane results in the circuit resuming its normal operation.

The circuit includes a first or primary transistor having first, second and control electrodes with a relatively small sensing resistor coupled between a reference voltage source and the first electrode. The second electrode of the transistor is coupled via a diode to the output terminal of the circuit. A second or control transistor having first, second and control electrodes is connected to be responsive to changes in the current flow through the sensing resistor. The first electrode of the second transistor is coupled to the reference voltage source and its second electrode is coupled via a large current-limiting resistor to the system ground. The control electrode of the first transistor is coupled to the second electrode of the second transistor.

In normal operation, the first and second transistors are conductive with the voltage difference between the reference voltage and system ground, typically 5 volts, causing current flow through the sensing resistor which enables the second transistor to become conductive. When the voltage at the backplane output is below the reference voltage, the first transistor is conductive and the diode is forward biased to provide the reference voltage at the output terminal. However, should the backplane short-circuit, the voltage at the output terminal will rapidly decrease causing an increased current flow through the sensing resistor and providing increased drive to the second transistor. The short circuit condition at the backplane thus causes the second transistor to more heavily conduct and quickly reduces the drive from the control electrode of the first transistor in order to protect the reference voltage source from an unlimited current surge. The limit resistor serves to prevent the second transistor from entering saturation so that upon correction of the problem at the backplane the circuit promptly resumes normal operation.

Further features and advantages of the invention will become more readily apparent from the following detailed description of a preferred embodiment thereof when taken in conjunction with the accompanying drawing.

DETAILED DESCRIPTION OF THE PREFERRED EMBODIMENT

Figure 1:
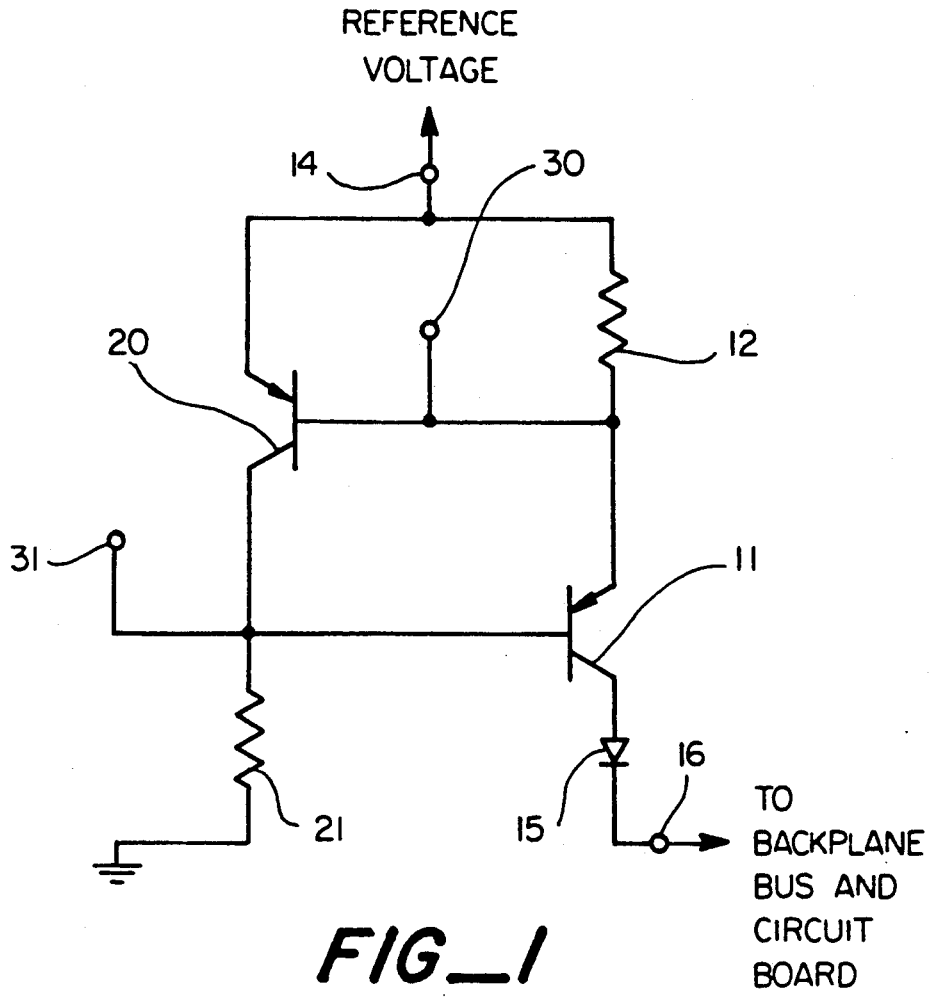
FIG. 1 is an electrical schematic drawing of one embodiment of the invention.
Figure 3:
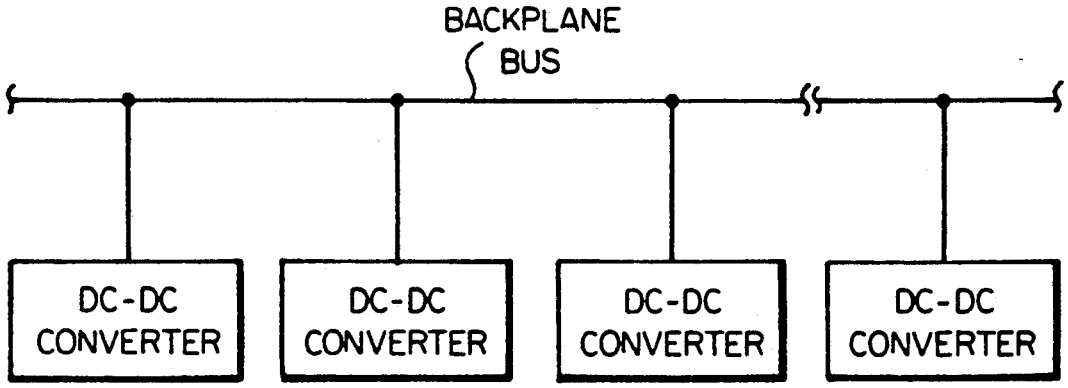
FIG 3 (PRIOR ART)
FIGS. 3 and 4 illustrate prior art circuits.

Referring now to FIG. 1, the electrical circuit of the present invention is shown comprising first PNP transistor 11 having its emitter electrode connected to sensing resistor 12. The sensing resistor is connected to input terminal 14 which is then coupled to a reference voltage source, typically a DC-to-DC voltage converter which provides a +5 V reference voltage at terminal 14.

The collector electrode of transistor 11 is connected to the positive electrode of diode 15. The negative electrode of the diode is connected to output terminal 16 which in turn is coupled to a reference voltage backplane bus on the backplane for use by the circuit boards of the telecommunication system. The diode 15 is preferably one having a low forward voltage drop across its p-n junction and a rapid transition to its nonconductive state when back-biased. The Schottky diode has been successfully tested and operated in this embodiment of the circuit. The sensing resistor 12 is preferably a relatively low resistance resistor of the order of tenths of an ohm so as to limit voltage drop in the forward direction, i.e. the drop from terminal 14 to terminal 16, of the circuit. The low impedance of the sensing resistor results in the first transistor 11 operating in the saturation mode which is characterized by low impedance. Thus, the total forward voltage drop across the serial combination of sensing resistor 12, first transistor 11 operating in saturation and diode 15 is primarily a function of the current flowing through the sensing resistor. Under normal operating conditions, the function of the reference voltage protective circuit is to maintain the backplane output 16 in a known state until the backplane is driven to a different voltage level by a signal from another circuit board. Thus, the protective circuit approximates an ideal voltage source in that the internal impedance in the forward direction approaches zero and essentially the full reference voltage is provided at the backplane output 16.

The second PNP transistor 20 is shown with its emitter electrode coupled to the input terminal 14 and its base or control electrode coupled to the emitter electrode of first transistor 11. The base-emitter voltage of transistor 20 is determined by the amount of the current through resistor 12. The collector electrode of transistor 20 is coupled by means of limit resistor 21 to system ground. The limit resistor 21 is substantially larger than the sensing resistor 12 since it is provided to limit the current flow through transistor 20 and to prevent the transistor 20 from operating in saturation. In a preferred embodiment, resistor 12 is 0.39 ohms and resistor 21 is 270 ohms.

When the circuit is in normal operation, transistor 11 is conductive with a current flow through resistor 12 then establishing the base-emitter voltage VBE for transistor 20. It too is conductive with its collector current being limited by the relatively high value of the resistor 21. The reference voltage at terminal 14 is provided to the output terminal 16 and the backplane sees a voltage source with low internal resistance. When the voltage at terminal 16 increases above the reference level, the diode 15 becomes reverse-biased. Reverse direction current flow through the diode does not take place. This prevents another reference voltage source, if used, from driving this protective circuit due to an imbalance in the circuit characteristics. In addition, the response of the diode is fast so that signals introduced to the backplane busses are not interfered with when the appear at the backplane.

In the case of a short-circuit occurring in the backplane connection from output 16, the present invention limits the supply of current to the backplane. As the first transistor 11 is operating in saturation, any further voltage increase across resistor 12 appears as an increase in the emitter-base voltage of transistor 20 driving it further into conduction. This transistor is maintained conductive so that it promptly responds to increased current flow through the sensing resistor. By driving transistor 20 more heavily into conduction, the current available at terminal 16 does not substantially increase. Thus, the current drain on the reference current supplied to terminal 14 is limited and the circuit components are protected against failure.

The base drive current for transistor 11 is not completely eliminated and this transistor remains in a conductive state even when transistor 20 is driven heavily into conduction. As a result, the circuit will self-correct promptly upon the cessation of the short-circuit condition at the backplane. The current limiting effect of large resistor 21 serves to prevent the second transistor 20 from entering saturation so it too will promptly return to its normal operating condition. Terminals 30, 31 are preferably provided for test point access by testing equipment.

Figure 2:
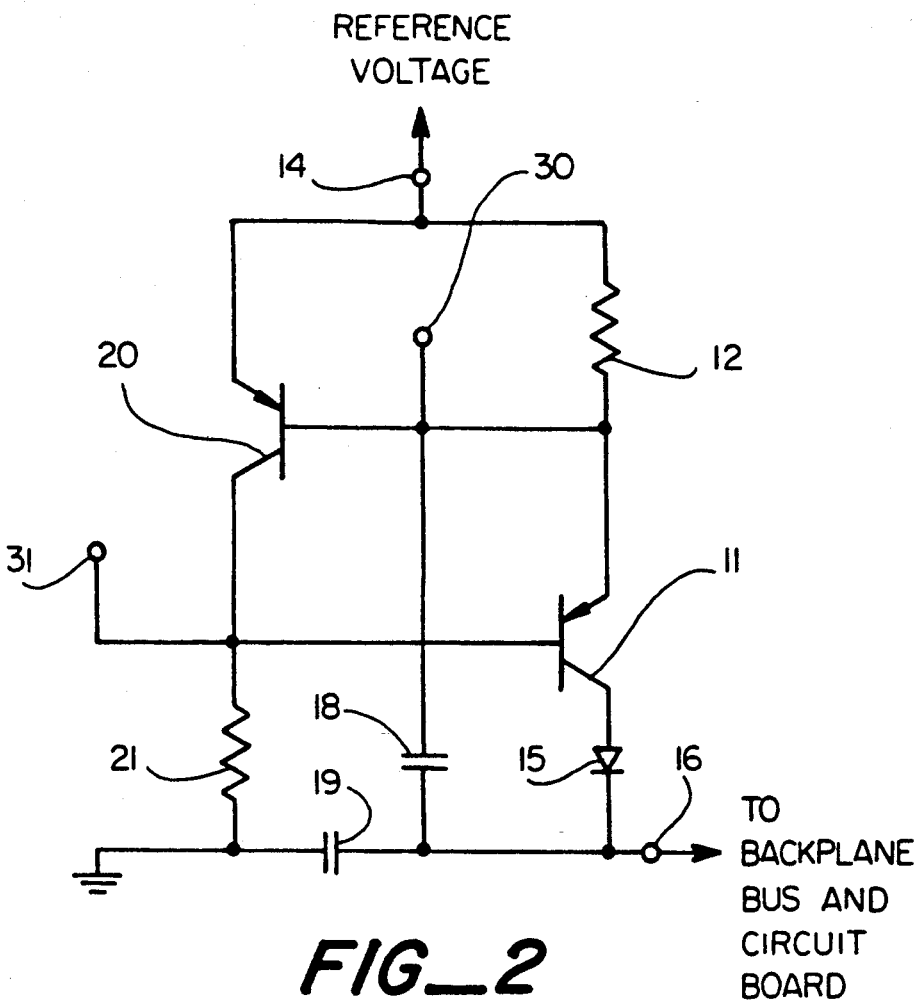
FIG. 2 is an electrical schematic drawings of a second embodiment of the invention.
Figure 4:
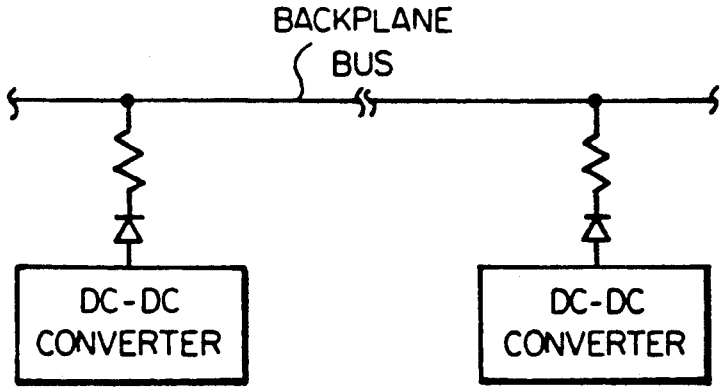
FIG 4 (PRIOR ART)

In the embodiment of FIG. 2, capacitors 18 and 19 have been added to the embodiment of FIG. 1. Capacitor 18 is provided between the base electrode of the second transistor 20 and the output terminal 16 to further improve the characteristic AC impedance of the circuit as seen from the backplane. The capacitor 18 appears as a short circuit to AC signals when the diode 15 is reverse biased. Thus, in the event that a plurality of reference voltage supply sources are used with a backplane and the voltage provided by one or more of the other sources is higher than that at terminal 16 by more than the small voltage drop across diode 15 in the forward direction, the backplane would see the relatively high DC impedance of a reverse-biased diode. By the addition of capacitor 18, the backplane sees a low AC impedance at terminal 16.

A second capacitor 19 may be added between the terminal 16 and the system ground for noise suppression. This capacitor enhances circuit performance by keeping the output terminal voltage from fluctuating at high frequencies. The capacitor does not affect the operation of the present invention under normal operating conditions, but has been found beneficial under high noise operating conditions.

According to a preferred embodiment, the circuit of the invention is useable for a backplane for an office interface unit in a telephone central office. Preferably two circuits are connected in parallel to the backplane to provide redundancy. If desired, a separate circuit can be provided for each circuit board to be used, with the circuits being connected in parallel.

While the above description has referred to specific embodiments of the invention, it will be apparent that variations and modifications may be made therein without departing from the scope of the invention as claimed.

What is claimed is:

1. An electrical circuit for establishing a stable voltage at an output terminal while limiting output current at said terminal, said circuit comprising:

a first transistor having first, second and control electrodes;

a sensing resistor coupled between a reference voltage source and the first electrode of the first transistor;

a diode coupled between the second electrode of the first transistor and the output terminal;

a second transistor having first, second and control electrodes, the first electrode being coupled to the reference voltage source, the control electrode being coupled to the first electrode of the first transistor, current flow through the second transistor being determined in part by the voltage across the sensing resistor, the control electrode of the first transistor being connected to the second electrode of the second transistor, and a current limiting resistor coupled between the second electrode of the second transistor and a current sink;

a capacitor connected in parallel across the first transistor and the diode to establish a low AC impedance path thereacross;

the first and second transistors being maintained conductive during operation to provide a stable voltage at the circuit output terminal, the currents through the transistors varying during operation to limit output current at the output terminal.

2. The invention of claim 1, wherein said diode is characterized by a low voltage drop thereacross in the forward direction.

3. The invention of claim 2, wherein the current-limiting resistor has a resistance substantially larger than the sensing resistor.

4. The invention of claim 3, wherein the current limiting resistor prevents saturation of the second transistor.

5. The invention of claim 1, wherein the resistance of the sensing resistor is low to permit the first transistor to operate in saturation.

6. A circuit for providing a stable voltage to a circuit board, said circuit being coupled to a reference voltage source, the circuit comprising:

a primary transistor having a primary emitter-collector circuit and a base electrode;

a sensing resistor connected in the primary emitter-collector circuit;

a diode connected in the primary emitter-collector circuit;

means for coupling the primary emitter-collector circuit between the reference voltage source and the circuit board whereby a first current in said primary emitter-collector circuit provides a voltage across the sensing resistor;

a secondary transistor having a secondary emitter-collector circuit and a base electrode, the base electrode being coupled to the primary emitter-collector circuit, the base electrode of the primary transistor being coupled to the collector circuit of the secondary transistor;

a current limiting resistor connected in the secondary emitter-collector circuit;

means for coupling the secondary emitter-collector circuit between the reference voltage source and ground whereby a second current in said secondary circuit provides a voltage across the current-limiting resistor;

means for coupling the base electrode of the primary transistor to the secondary emitter-collector circuit, said primary and secondary transistors being maintained in conduction with the secondary transistor limiting the first current through the primary transistor; and a first capacitor connected between the base electrode of the secondary transistor and the circuit board to establish a low AC impedance path thereacross.

7. The invention of claim 6, wherein said diode is characterized by a low voltage drop thereacross in the forward direction.

8. The invention of claim 7, wherein said current limiting resistor prevents the secondary transistor from operating in saturation.

* * * * *